US009316032B2

(12) United States Patent
Roy et al.

(10) Patent No.: US 9,316,032 B2
(45) Date of Patent: Apr. 19, 2016

(54) VEHICLE DOOR CHECKER

(71) Applicant: HONDA MOTOR CO., LTD., Tokyo (JP)

(72) Inventors: Nathan Roy, Delaware, OH (US); Teruo Yamazaki, Dublin, OH (US); Aaron Heller, Lewis Center, OH (US)

(73) Assignee: Honda Motor Co., Ltd., Tokyo (JP)

( * ) Notice: Subject to any disclaimer, the term of this patent is extended or adjusted under 35 U.S.C. 154(b) by 63 days.

(21) Appl. No.: 14/196,288

(22) Filed: Mar. 4, 2014

(65) Prior Publication Data

US 2015/0252599 A1 Sep. 10, 2015

(51) Int. Cl.
*E05C 17/20* (2006.01)
*E05B 77/34* (2014.01)

(52) U.S. Cl.
CPC ..... *E05C 17/203* (2013.01); *E05B 77/34* (2013.01); *Y10T 16/61* (2015.01); *Y10T 29/49826* (2015.01); *Y10T 29/49947* (2015.01)

(58) Field of Classification Search
CPC ..... E05C 17/025; E05C 17/18; E05C 17/20; E05C 17/203; E05C 17/206; E05C 17/22; E05C 17/24; E05D 11/0054; E05D 2011/0072; E05B 17/002; E05B 77/34; Y10T 16/533; Y10T 16/5335; Y10T 16/6295; Y10T 16/61; Y10T 292/28
See application file for complete search history.

(56) References Cited

U.S. PATENT DOCUMENTS

| | | | | |
|---|---|---|---|---|
| 1,485,477 | A * | 3/1924 | Behn | 16/82 |
| 2,237,046 | A * | 4/1941 | Breitenwischer | 16/86 C |
| 2,290,331 | A * | 7/1942 | Jacobs | 16/86 C |
| 2,462,300 | A * | 2/1949 | Berkson | 16/251 |
| 2,550,626 | A * | 4/1951 | Vollmer | 292/275 |
| 2,720,000 | A * | 10/1955 | Gussack | 16/82 |
| 2,915,778 | A * | 12/1959 | De Vito | 16/82 |
| 2,915,779 | A * | 12/1959 | Allen | 16/82 |
| 3,422,486 | A * | 1/1969 | Thomas, Jr. | 16/251 |
| 4,103,701 | A * | 8/1978 | Jeng | 137/375 |
| 4,847,948 | A * | 7/1989 | Gross et al. | 16/251 |
| 4,856,141 | A * | 8/1989 | Sassenberg | 16/250 |
| 5,173,991 | A | 12/1992 | Carswell | |
| 5,727,287 | A * | 3/1998 | Hosken et al. | 16/82 |
| 6,015,182 | A * | 1/2000 | Weissert et al. | 296/146.6 |
| 6,145,163 | A * | 11/2000 | Mitchell et al. | 16/82 |
| 6,446,305 | B1 | 9/2002 | Kneeland | |
| 6,513,193 | B1 * | 2/2003 | Yezersky et al. | 16/86 C |
| 7,076,833 | B2 | 7/2006 | Murayama et al. | |

(Continued)

FOREIGN PATENT DOCUMENTS

| | | |
|---|---|---|
| EP | 472780 A1 | 3/1992 |
| JP | 9-177410 | 7/1997 |

(Continued)

*Primary Examiner* — Jeffrey O Brien

(74) *Attorney, Agent, or Firm* — Kenealy Vaidya LLP

(57) ABSTRACT

A door checker assembly includes a checker housing secured to the door. An elongated checker arm is dimensioned for and slidingly received through the checker housing so that a first end is received in the door and a second end is pivotally mounted to a body of the vehicle. An elongated cover is received in the door that overlies and extends along substantially an entire length of the checker arm for blocking water from falling thereon. The cover has a mounting portion at one end that is fastened between the checker housing and an inner face of the door with the same fasteners that secure the checker housing. The cover is preferably a stamped metal structure.

15 Claims, 4 Drawing Sheets

(56) References Cited

U.S. PATENT DOCUMENTS

| | | | | |
|---|---|---|---|---|
| 7,240,399 | B2 | 7/2007 | Murayama et al. | |
| 7,469,944 | B2 | 12/2008 | Kitayama et al. | |
| 7,552,953 | B2 | 6/2009 | Schmoll et al. | |
| 7,703,816 | B2 | 4/2010 | Kitayama et al. | |
| 7,861,372 | B2 | 1/2011 | Tashima et al. | |
| 7,913,354 | B2 | 3/2011 | Tashima et al. | |
| 8,438,884 | B1 * | 5/2013 | Bertrand | 70/54 |
| 2002/0069481 | A1 * | 6/2002 | Ashline et al. | 16/49 |
| 2002/0078526 | A1 * | 6/2002 | Kincaid | 16/250 |
| 2002/0101094 | A1 * | 8/2002 | Griffis | 296/146.1 |
| 2002/0112317 | A1 | 8/2002 | Hayashi | |
| 2003/0159243 | A1 * | 8/2003 | Audisio | 16/82 |
| 2006/0278234 | A1 * | 12/2006 | Maatta et al. | 128/206.19 |
| 2007/0040392 | A1 | 2/2007 | Matsuki | |
| 2007/0180653 | A1 * | 8/2007 | Hulbert et al. | 16/233 |
| 2007/0241569 | A1 * | 10/2007 | Kitayama et al. | 292/262 |
| 2010/0088850 | A1 * | 4/2010 | Dringenberg | 16/251 |
| 2011/0169297 | A1 | 7/2011 | Nigel et al. | |
| 2012/0233813 | A1 | 9/2012 | Settsu et al. | |
| 2012/0233814 | A1 | 9/2012 | Minegishi | |
| 2013/0074412 | A1 | 3/2013 | Wellborn et al. | |
| 2014/0026361 | A1 * | 1/2014 | Kim | 16/251 |
| 2014/0312649 | A1 * | 10/2014 | Hashiguchi | 296/146.5 |
| 2015/0107052 | A1 * | 4/2015 | Talpe | 16/251 |

FOREIGN PATENT DOCUMENTS

| | | |
|---|---|---|
| JP | 11-229696 | 8/1999 |
| JP | 2008-291599 | 12/2008 |
| WO | WO 2013/057916 A1 | 4/2013 |

* cited by examiner

VEHICLE DOOR CHECKER

BACKGROUND

The present disclosure relates to a vehicle door checker used to hold vehicle doors in one of a number of desired positions, for example, three-quarters open, one-half, and fully opened. Typically, a vehicle door checker assembly includes a checker arm pivotally attached at one or a first end to a frame or body of the vehicle. An other or second end of the arm extends through a checker housing and terminates or is received inside a vehicle door. As the door is opened and closed relative to the vehicle body, the checker housing slides over the arm between the first and second ends.

Reduced cross-sectional regions along the length of the checker arm, sometimes referred to as notches, correspond to the desired positions for holding the vehicle door partially or fully opened. A slider or elastic member made of an elastic material is retained in the housing and compresses against the outer surface of the arm to generate a detent, holding force on the arm. When the holding force is exceeded, the slider moves past the peak or notch in the arm.

The checker housing is usually mounted on the inside of the vehicle door, such as being bolted to an inner face of a door panel. Water can drip down through the vehicle door and rest on the checker harm. In sufficiently cold temperatures, the moisture is susceptible to freezing and forms ice on at least one of the door checker arm or inside the checker housing. This can adversely impact operation of the door checker assembly.

Current designs using EPDM or hard plastic to enclose the arm, and such arrangements are attached to the door checker housing. Commonly owned patent U.S. Pat. No. 7,703,816 employs a water management dam to provide a barrier in the door checker housing.

A need exists, however, to more effectively block water from reaching the door checker arm or door checker housing.

BRIEF DESCRIPTION

A door checker assembly includes a housing secured at one of a body and a door that is pivotally mounted to the body. The assembly includes an elongated checker arm secured to the other of the body and the door, where the checker arm is dimensioned for selective sliding receipt through the housing. An elongated cover overlies and extends along substantially an entire length of the checker arm for blocking water from falling thereon.

The elongated cover is metal.

The elongated cover has a mounting portion at one end that extends generally perpendicular to a remainder of the cover.

The mounting portion is secured to the housing with fasteners that secure the housing to the one of the body and the door.

The elongated cover has a first width dimension at a first end and a different, second width dimension at a second end, and the first width dimension is greater than the second width dimension.

A method of assembling a door checker assembly includes mounting a door checker housing on a vehicle door, securing a door checker arm through the housing such that a first end is received in the vehicle door and a second end is pivotally secured to a body of the vehicle. The method further includes installing a cover to the vehicle door over the door checker arm to block water from reaching the door checker arm.

The method includes securing the cover to the door with the same fasteners used to secure the door checker housing The method also includes stamping the cover from metal.

The method further includes arranging the cover to overlie both the door checker housing and the length of the door checker arm when the door is closed relative to the vehicle body.

The method additionally includes inserting a perpendicular mounting portion of the door checker cover between the door checker housing and a panel of the door.

A primary benefit is the ability to limit the potential for water forming ice and impacting operation of the door checker assembly.

Another advantage resides in the ability to use existing mounting hardware to accommodate the cover.

A further feature is associated with limiting the potential for water entry onto the door checker arm and into the door checker housing.

Still other benefits and advantages of the present disclosure will become more apparent from reading and understanding the following detailed description.

DETAILED DESCRIPTION

Figure 1:
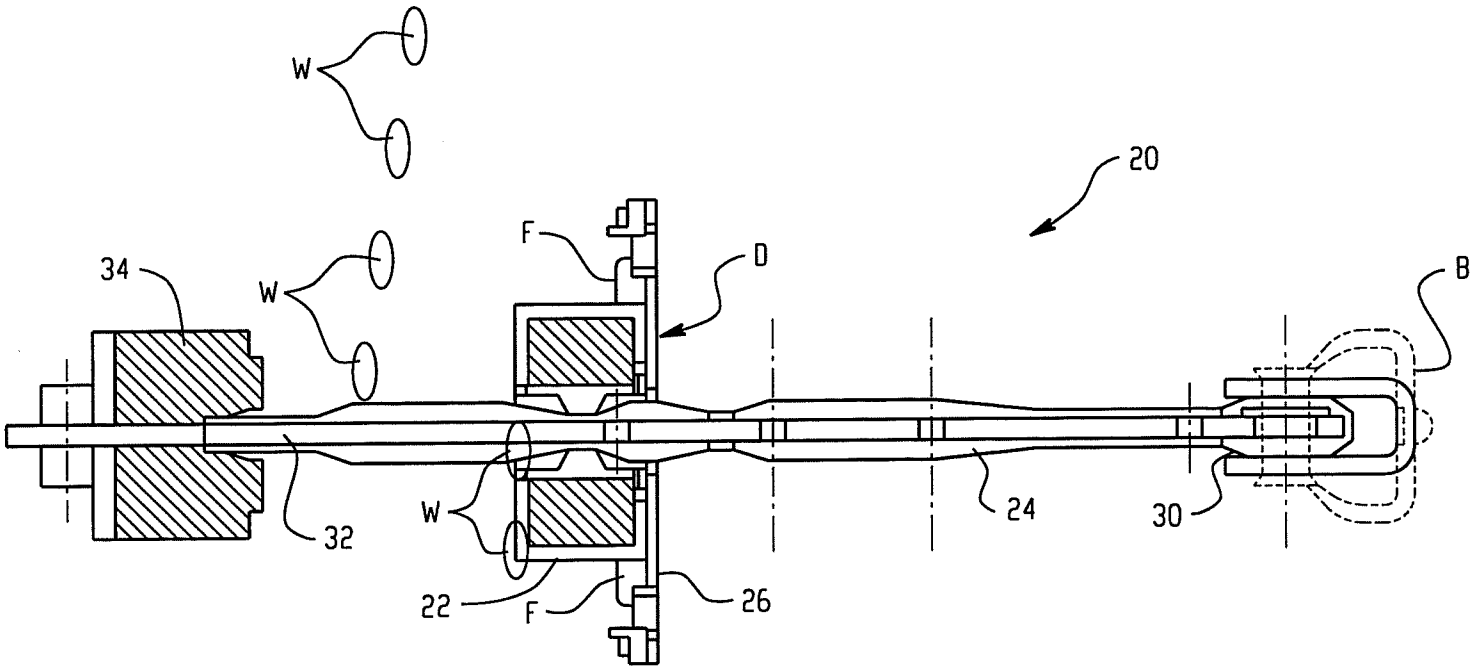
Fig. 1 PRIOR ART
FIG. 1 is a cross-sectional view of a prior art door checker assembly that demonstrates the problem of water dripping on the door checker arm and collecting inside the door checker housing.

Turning first to FIG. 1, there is shown a door checker assembly 20 that includes a checker housing 22 that receives a checker arm 24 therethrough. The checker housing 22 is shown secured to an inner surface of door panel 26 of door D via fasteners such as threaded bolts F. A first end 30 of the door checker arm 24 is pivotally mounted to a vehicle body B, while a second end 32 is secured to a stopper 34. As represented by droplets W, moisture such as water drips or falls onto the door checker arm 24 inside the vehicle door, and/or becomes trapped inside the checker housing 22. When exposed to sufficiently cold temperatures, the water W forms ice that potentially interferes with normal operation of the door checker assembly 20.

To eliminate ice formation, the present disclosure of FIGS. 2-8 limits the potential for water W to be exposed to door checker assembly 120. More specifically, like components will be identified by like reference numerals in the 100 series (e.g., door checker assembly 20 in FIG. 1 is now referenced as door checker assembly 120 in FIGS. 2-8, and new components will be identified by new reference numerals). The door checker assembly 120 likewise includes a checker housing 122 that receives a checker arm 124 therethrough. The checker housing 122 is shown secured to an inner surface of door panel 126 of door D via fasteners F. A first end 130 of the door checker arm 124 is pivotally mounted to a vehicle body B, while a second end 132 is secured to a stopper 134. If desired, these components and their structure and function remain substantially unchanged from that assembly in the prior art arrangement of FIG. 1.

Figure 2:
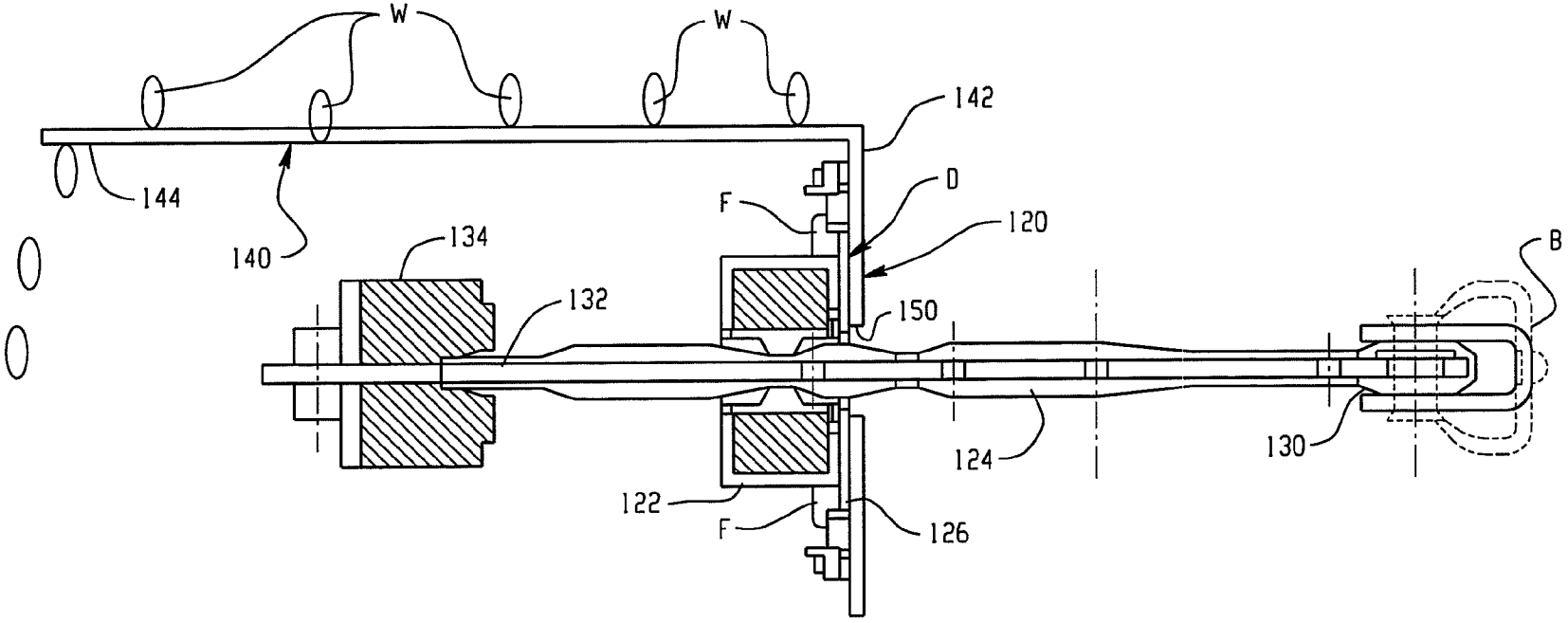
FIG. 2 is a cross-sectional view of the present disclosure that addresses the water issue of FIG. 1.
Figure 3:
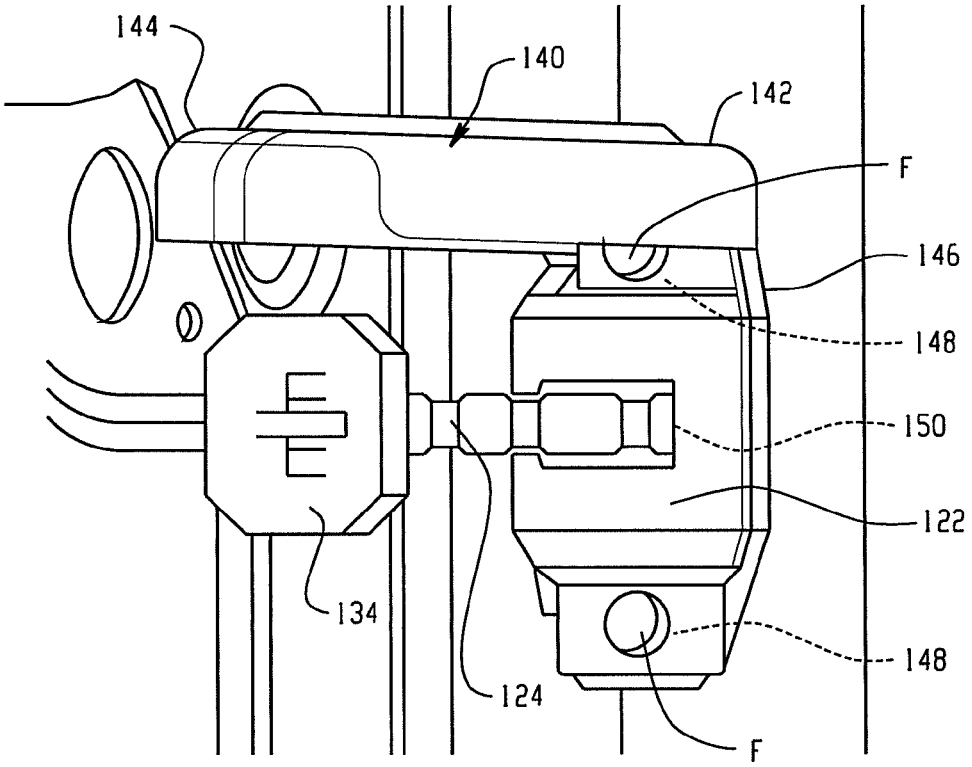
FIG. 3 is a perspective view of an interior of a door panel that includes the door checker assembly with cover of the present disclosure.
Figure 4:
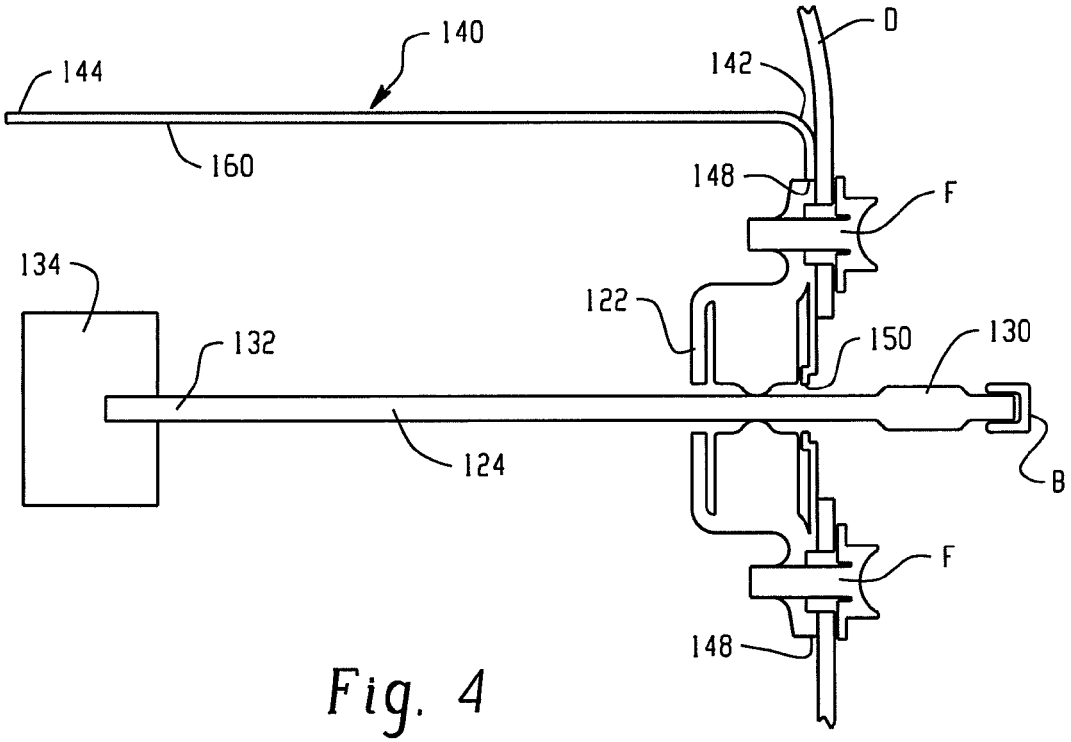
FIG. 4 is a cross-sectional view similar to FIG. 2.
Figure 5:
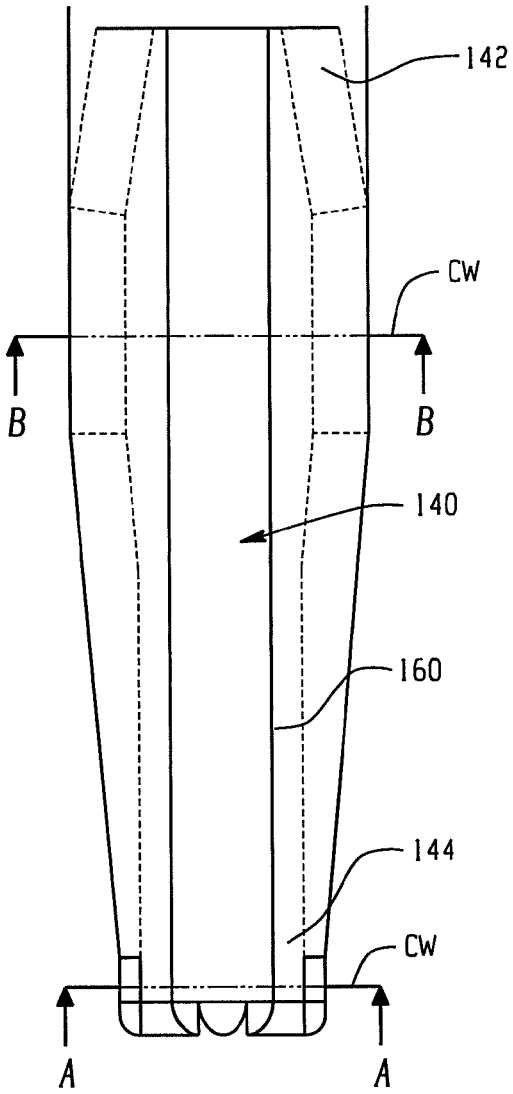
FIG. 5 is a top plan view of the cover employed in the door checker assembly of the present disclosure.
Figure 6:
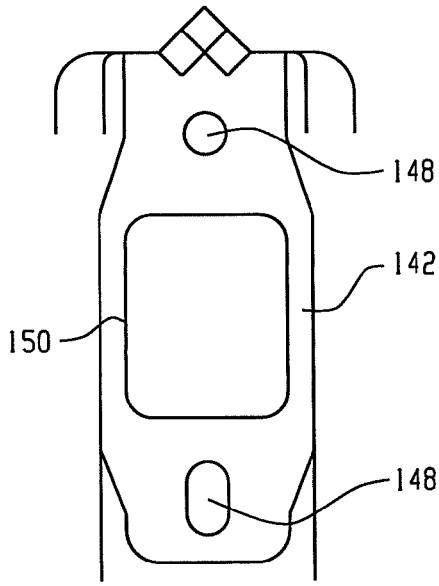
FIG. 6 is an end view of the cover employed in the door checker assembly of the present disclosure.

To address the moisture or water/ice issue, the door checker assembly 120 of the present disclosure incorporates a cover or shield 140 that blocks water from reaching or dripping on to the checker arm 124. Specifically, the cover 140 (sometimes referred to as a checker barn) is an elongated, stamped metal structure that has a first end 142 mounted or secured to an inner face 126 of the vehicle door D, and a second end 144 that is longitudinally spaced from the first end by a dimension that is slightly greater than a length of the checker arm 124 received in the door when the door is closed relative to the vehicle body B (FIGS. 2-4). The cover 140 includes a mounting portion 146 at the first end 142. Preferably, the mounting portion 146 is formed as a generally perpendicular portion that is downturned relative to the remainder of the elongated length of the cover 140. The mounting portion 146 includes fastener receiving openings 148 that mate with corresponding openings in the checker housing 122 to receive the fasteners F therethrough. In other words, the mounting portion 146 is preferably interposed between the checker housing 122 and the inner face 126 of the vehicle door D, and secured to the vehicle door with the same fasteners F so that additional hardware is not required to incorporate the cover into the arrangement. It will be appreciated that an additional opening 150 is required through the mounting portion to allow passage of the checker arm 124 that extends through the checker housing 122 and corresponding openings in the vehicle door panel. As a result, the cover 140 has a generally L-shaped configuration where an elongated cover portion 160 is cantilever mounted and extends in a longitudinal direction from the mounting portion 146. The cover portion 160 extends in spaced or offset position relative to the checker arm 124 as the cover portion proceeds longitudinally away from the mounting portion 146.

As more particularly evident in FIGS. 5-8, the cover portion 160 of the cover 140 has a first width "CW" adjacent the mounting portion that is sufficient to encompass or shield the width of the checker housing 122. A second or distal end 162 of the cover portion 160 has a narrower, second width "cw" less than the first width CW of the cover portion since the remainder of the cover portion need only be sufficiently wide to shield the narrower dimension of the checker arm 124.

Figure 7:
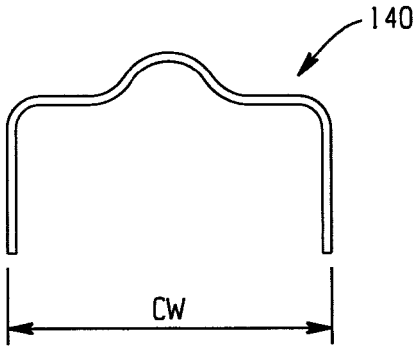
FIG. 7 is a cross-sectional view of the cover taken generally along the lines A-A of FIG. 5.
Figure 8:
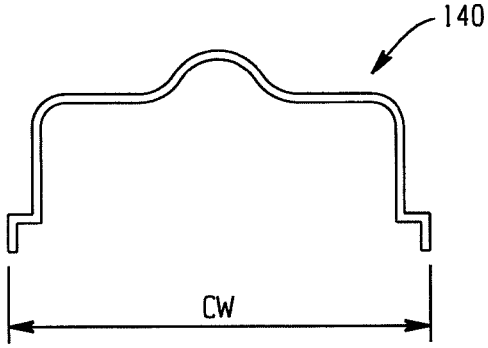
FIG. 8 is a cross-sectional view of the cover taken generally along the lines B-B of FIG. 5.

The cover portion 160 may adopt a wide variety of conformations or configurations including the inverted, generally U-shape illustrated in FIGS. 7 and 8. This inverted, generally U-shape is desirable since any water W that drops toward the checker assembly 120 in the vehicle door D will likely collect on the upper surface of the cover portion 160, and once sufficient moisture or water has collected on the upper surface, the water will then run off the rounded edges of the cover portion, thus bypassing the checker housing 122 and the checker arm 124. This minimizes the potential for moisture to collect on the checker arm 124, or in the checker housing 122, as a result of water that falls from above the door checker assembly 120 in the vehicle door D. Consequently, reduced moisture or water in either the checker housing 122 or checker arm 124 likewise reduces the prospect for ice formation in cold temperatures that would otherwise potentially adversely impact normal operation of the door checker assembly 120.

This written description uses examples to describe the disclosure, including the best mode, and also to enable any person skilled in the art to make and use the disclosure. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims. Moreover, this disclosure is intended to seek protection for a combination of components and/or steps and a combination of claims as originally presented for examination, as well as seek potential protection for other combinations of components and/or steps and combinations of claims during prosecution.

We claim:

1. A door checker assembly comprising:

a vehicle body; a door pivotally mounted to the vehicle body;

a housing secured to one of the vehicle body and the door;

an elongated checker arm secured to the other of the body and the door, the checker arm dimensioned for selective sliding receipt through the housing; and an elongated metal cover mounted inside the door and having a length slightly greater than the checker arm received in the door, and overlying and extending along substantially an entire length of the checker arm for blocking water from falling thereon, the elongated metal cover having a substantially U-shape, oriented such that a pair of edges of the elongated metal cover are closer to the door checker arm than a protruding center of the U-shape is to the door checker arm.

2. The door checker assembly of claim 1 wherein the elongated cover has a mounting portion at one end that extends generally perpendicular to a remainder of the cover.

3. The door checker assembly of claim 2 wherein the mounting portion is secured to the housing with fasteners that secure the housing to the one of the body and the door.

4. The door checker assembly of claim 1 wherein the elongated cover and the door checker arm extend substantially parallel to one another.

5. The door checker assembly of claim 1 wherein the elongated cover has a first width dimension at a first end and a different, second width dimension at a second end, and wherein each of the first and second width dimensions are symmetric about the door checker arm.

6. The door checker assembly of claim 5 wherein the first width dimension is greater than the second width dimension.

7. The door checker assembly of claim 6 wherein the first width dimension is disposed adjacent a mounting portion that extends generally perpendicular to a remainder of the cover.

8. A door checker assembly operatively mounted to an associated vehicle having a body and a door pivotally mounted to the body, the door check assembly comprising:

a checker housing secured to the door;

an elongated checker arm dimensioned for and slidingly received through the checker housing so that a first end is received in the door and a second end is pivotally mounted to the body of the vehicle;

an elongated metal cover received inside the door, the elongated metal cover having a substantially U-shape and oriented such that a pair of edges of the elongated metal cover are closer to the door checker arm than a protruding center of the U-shape is to the door checker arm and having a length slightly greater than the checker arm, and that overlies and extends along substantially an entire length of the checker arm when the checker arm is received in the door and blocking water from falling thereon; and the elongated cover has a mounting portion that extends generally perpendicular to a remainder of the cover, and the mounting portion is secured to the checker housing with fasteners that secure the housing to the door.

9. The door checker assembly of claim 8 wherein the elongated cover extends in an offset, substantially parallel relation with the length of the checker arm when the door is closed relative to the body.

10. The door checker assembly of claim 9 wherein the elongated cover has a first width dimension at a first end and a different, second width dimension at a second end, and wherein each of the first and second width dimensions are symmetric about the door checker arm.

11. The door checker assembly of claim 10 wherein the elongated cover overlies the housing at the first end and overlies a stop member on the checker arm at the second end.

12. The door checker assembly of claim 11 wherein the cover first end has a greater width than the cover second end.

13. A method of assembling a door checker assembly to a vehicle having a body in the door pivotally mounted to the body, the assembly method comprising:

mounting a door checker housing on the vehicle door;

securing a door checker arm through the housing such that a first end is received in the vehicle door and a second end is pivotally secured to a body of the vehicle;

installing an elongated metallic cover, that has a length slightly greater than the checker arm in the vehicle door over the door checker arm to block water from reaching the door checker arm;

securing the cover to the door with fasteners also used to mount the door check housing to the vehicle door;

forming the elongated metal cover to have a substantially U-shape; and orienting the elongated metal cover such that a pair of edges of the elongated metal cover are closer to the door checker arm than a protruding center of the U-shape is to the door checker arm.

14. The method of claim 13 further comprising arranging the cover to overlie both the door checker housing and the length of the door checker arm when the door is closed relative to the vehicle body.

15. The method of claim 13 further comprising inserting a perpendicular mounting portion of the door checker cover between the door checker housing and a panel of the door.

* * * * *